US008853929B2

(12) United States Patent
Kameda et al.

(10) Patent No.: US 8,853,929 B2
(45) **Date of Patent: *Oct. 7, 2014**

(54) PLASMA JET IGNITION PLUG

(75) Inventors: Hiroyuki Kameda, Nagakute (JP); Daisuke Nakano, Kiyosu (JP); Naofumi Yamamura, Nagoya (JP); Daisuke Kasahara, Toyoake (JP); Yoshikuni Sato, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/703,464

(22) PCT Filed: Jun. 14, 2011

(86) PCT No.: PCT/JP2011/063593

§ 371 (c)(1),
(2), (4) Date: Dec. 11, 2012

(87) PCT Pub. No.: WO2011/158830

PCT Pub. Date: Dec. 22, 2011

(65) Prior Publication Data

US 2013/0088140 A1 Apr. 11, 2013

(30) Foreign Application Priority Data

Jun. 18, 2010 (JP) ..... 2010-139073
Sep. 10, 2010 (JP) ..... 2010-202640
Jun. 14, 2011 (JP) ..... 2011-131845

(51) Int. Cl.

| | |
|---|---|
| ***H01T 13/54*** | (2006.01) |
| ***H01T 13/52*** | (2006.01) |
| ***F02P 9/00*** | (2006.01) |
| ***H01T 13/20*** | (2006.01) |

(52) U.S. Cl.

CPC ..... *H01T 13/54* (2013.01); *H01T 13/52* (2013.01); *F02P 9/007* (2013.01); *H01T 13/20* (2013.01)

USPC ..... 313/143

(58) Field of Classification Search

None

See application file for complete search history.

(56) References Cited

U.S. PATENT DOCUMENTS

| | | | | |
|---|---|---|---|---|
| 4,388,549 | A | 6/1983 | Bensman | 313/138 |
| 7,305,954 | B2 | 12/2007 | Hagiwara et al. | 123/143 |

(Continued)

FOREIGN PATENT DOCUMENTS

| | | | |
|---|---|---|---|
| CN | 1820141 | 8/2006 | F02P 9/00 |
| EP | 2 166 628 | 3/2010 | H01T 13/20 |

(Continued)

OTHER PUBLICATIONS

International Search Report for International Application No. PCT/JP2011/063593, Sep. 13, 2011.

(Continued)

*Primary Examiner* — Ashok Patel

(74) *Attorney, Agent, or Firm* — Kusner & Jaffe

(57) ABSTRACT

An ignition plug providing excellent ignition performance that can be maintained over a long period of time by restraining channeling. The ignition plug includes a ceramic insulator having an axial bore, a center electrode inserted into the axial bore, a metallic shell, and a ground electrode fixed to the metallic shell, and has a cavity defined by an inner circumferential surface of the axial bore and the forward end surface of the center electrode. The axial bore includes a first straight portion and a diameter-reducing portion. As viewed on a section which contains an axis (CL1) of the ignition plug, a relational expression $\alpha \geq 10$ is satisfied, where $\alpha$ (°) is an acute angle formed by a straight line orthogonal to the axis (CL1) and the outline of the diameter-reducing portion.

9 Claims, 9 Drawing Sheets

(56) References Cited

U.S. PATENT DOCUMENTS

| | | | | |
|---|---|---|---|---|
| 7,328,677 | B2 | 2/2008 | Hagiwara et al. | 123/143 |
| 7,477,008 | B2 | 1/2009 | Artmann et al. | 313/143 |
| 8,253,312 | B2 * | 8/2012 | Kameda et al. | 313/141 |
| 8,441,177 | B2 * | 5/2013 | Kameda | 313/143 |
| 2003/0085643 | A1 * | 5/2003 | Matsubara | 313/141 |
| 2005/0200255 | A1 * | 9/2005 | Yoshimoto et al. | 313/143 |
| 2006/0137642 | A1 | 6/2006 | Artmann et al. | 123/169 |
| 2007/0221157 | A1 | 9/2007 | Hagiwara et al. | 123/143 |
| 2009/0227168 | A1 * | 9/2009 | Nakamura et al. | 445/7 |
| 2010/0102728 | A1 | 4/2010 | Kato et al. | 315/111.21 |

FOREIGN PATENT DOCUMENTS

| | | | |
|---|---|---|---|
| JP | 1274374 | 11/1989 | F02P 13/00 |
| JP | 2007-287666 | 11/2007 | H01T 13/54 |
| WO | WO 2008/156035 | 12/2008 | H01T 13/20 |

OTHER PUBLICATIONS

Office Action (dated Aug. 14, 2013) issued in connection with corresponding Chinese Patent Application No. 2011800301740, including English translation.

* cited by examiner (a)

(b)

PLASMA JET IGNITION PLUG

FIELD OF THE INVENTION

The present invention relates to a plasma jet ignition plug for igniting an air-fuel mixture through formation of plasma.

BACKGROUND OF THE INVENTION

Conventionally, a combustion apparatus, such as an internal combustion engine, uses a spark plug for igniting an air-fuel mixture through spark discharge. In recent years, in order to meet demand for high output and low fuel consumption of a combustion apparatus, a plasma jet ignition plug has been proposed, since the plasma jet ignition plug provides quick propagation of combustion and can more reliably ignite even a lean air-fuel mixture having a higher ignition-limit air-fuel ratio.

Generally, the plasma jet ignition plug includes a tubular insulator having an axial bore, a center electrode inserted into the axial bore in such a manner that a forward end surface thereof is retracted from a forward end surface of the insulator, a metallic shell disposed externally of the outer circumference of the insulator, and an annular ground electrode joined to a forward end portion of the metallic shell. Also, the plasma jet ignition plug has a space (cavity) defined by the forward end surface of the center electrode and an inner circumferential surface of the axial bore, and the cavity communicates with an ambient atmosphere via a through hole formed in the ground electrode.

Such a plasma jet ignition plug ignites an air-fuel mixture as follows. First, voltage is applied between the center electrode and the ground electrode, thereby generating spark discharge therebetween and thus causing dielectric breakdown therebetween. In this condition, high-energy current is applied between the center electrode and the ground electrode for effecting transition of a discharge state, thereby generating plasma within the cavity. The generated plasma is discharged through an opening of the cavity, thereby igniting the air-fuel mixture.

Meanwhile, according to a conceivable technique for implementing further superior ignition performance, higher energy is imparted to current to be applied after spark discharge, for generating larger plasma. However, when high-energy current is applied, the center electrode is apt to be eroded, potentially resulting in a rapid increase in voltage required for spark discharge (discharge voltage).

In order to cope with the above problem, there is proposed a technique for implementing excellent ignition performance even with relatively-low-energy current through provision of a throttle in the cavity by means of provision, on the inner circumferential surface of the cavity, of a stepped portion or a diameter-reducing portion whose diameter reduces along the forward direction (for example, refer to WO2008/156035A1 "Patent Document 1").

SUMMARY OF THE INVENTION

Problems to be Solved by the Invention

Spark discharge is generated between the center electrode and the ground electrode while creeping on the inner circumferential surface of the insulator. Accordingly, there arises the phenomenon (known as channeling) that spark discharge erodes a portion of the insulator located on a spark discharge path. Spark discharge is generated between the center electrode and the ground electrode in a direction substantially along the axis, and in the case where a stepped portion is provided on the inner circumferential surface of the cavity, the stepped portion (an inner circumferential surface of the insulator) and the direction of spark discharge are substantially orthogonal to each other. Thus, spark discharge is excessively pressed against the inner circumferential surface (stepped portion) of the insulator. Therefore, channeling may rapidly progress at the stepped portion. When, as a result of progress of channeling, the volume of the cavity increases, the discharge pressure of plasma drops, and in turn, ignition performance may deteriorate.

In contrast, when, in place of the stepped portion, a continuously diameter-reducing; i.e., tapering, inner circumferential surface (a diameter-reducing portion) is provided, a situation can be prevented in which an inner circumferential surface of the insulator becomes orthogonal to the direction of spark discharge. However, in this case, according to the above-mentioned art, a portion of the inner circumferential surface of the insulator which is located closest to a forward end corner of the center electrode (a portion between the forward end surface and the side surface of the center electrode) coincides with a bend located at the rear end of the diameter-reducing portion. Therefore, since spark discharge is likely to be generated starting from a point of high electric field intensity, and the forward end corner of the center electrode and the bend are relatively high in electric field intensity and are located close to each other, spark discharge may be intensively generated along a path which passes through the bend. As a result, in association with spark discharge, channeling rapidly progresses at the bend, potentially resulting in an abrupt increase in the volume of the cavity and the occurrence of penetration through the insulator.

The present invention has been conceived in view of the above circumstances, and an object of the invention is to provide a plasma jet ignition plug which can maintain excellent ignition performance over a long period of time through restraint of rapid progress of channeling while ignition performance is improved.

SUMMARY OF THE INVENTION

Configurations suitable for achieving the above object will next be described in itemized form. When needed, actions and effects peculiar to the configurations will be additionally described.

Configuration 1:

A plasma jet ignition plug comprises an insulator having an axial bore extending in a direction of an axis; a center electrode inserted into the axial bore in such a manner that a forward end surface thereof is located rearward of a forward end of the insulator with respect to the direction of the axis; a metallic shell disposed externally of an outer circumference of the insulator; and a ground electrode fixed to a forward end portion of the metallic shell. A cavity is defined by an inner circumferential surface of the axial bore and the forward end surface of the center electrode. The plasma jet ignition plug is characterized in that the axial bore comprises a first straight portion having a fixed inside diameter and extending forward along the direction of the axis from a forward end surface of the center electrode, and a diameter-reducing portion whose diameter reduces forward along the direction of the axis from a forward end of the first straight portion, and that as viewed on a section which contains the axis, a relational expression $\alpha \geq 10$ is satisfied, where $\alpha$ (°) is an acute angle formed by a straight line orthogonal to the axis and an outline of the diameter-reducing portion.

The expression "a fixed inside diameter" refers to not only an inside diameter which is strictly fixed along the direction of the axis, but also an inside diameter which slightly varies along the direction of the axis. Therefore, for example, the inner circumferential surface may be inclined slightly (for example, within ±5°) from the axis (the same also applies in the following description).

According to the above configuration 1, the axial bore has the diameter-reducing portion whose diameter reduces forward with respect to the direction of the axis. Therefore, plasma discharge pressure directed toward the opening of the cavity (toward the forward side with respect to the direction of the axis) can be increased, whereby the discharge length of plasma from the opening of the cavity can be further increased. As a result, ignition performance can be improved.

Meanwhile, provision of the diameter-reducing portion involves concern about an abrupt increase in the volume of the cavity or a like problem. However, according to the above configuration 1, the angle $\alpha$ formed by the straight line orthogonal to the axis and the outline of the diameter-reducing portion is specified as 10° or more. Thus, the diameter-reducing portion is formed in such a manner as to follow the direction of spark discharge to the greatest possible extent without assuming a state of being orthogonal to the direction of spark discharge. Therefore, there can be more reliably restrained a situation in which spark discharge is generated while being excessively pressed against the diameter-reducing portion, so that rapid progress of channeling can be reliably prevented.

Furthermore, according to the above configuration 1, the first straight portion is provided between the forward end surface of the center electrode and the diameter-reducing portion. Thus, the forward end surface of the center electrode and a bend formed between the first straight portion and the diameter-reducing portion are spaced apart from each other with respect to the direction of the axis. Therefore, there can be more effectively prevented a situation in which spark discharge is intensively generated along a path which passes through the bend, whereby a spark discharge path can be more dispersed. As a result, coupled with the effect of an angle $\alpha$ of 10° or more, rapid progress of channeling can be quite effectively prevented.

As mentioned above, according to the above configuration 1, by means of the first straight portion being provided while the angle $\alpha$ is 10° or more, the demerit of rapid progress of channeling associated with provision of the diameter-reducing portion can be effectively solved, and the merit of improving ignition performance associated with provision of the diameter-reducing portion can be maintained over a long period of time.

Configuration 2:

A plasma jet ignition plug of the present configuration is characterized in that, in the above configuration 1, a relational expression $\alpha \leq 45$ is satisfied.

According to the above configuration 2, the angle $\alpha$ is specified as 45° or less. Thus, a space (a first cavity portion) whose circumference is defined by the diameter-reducing portion and the first straight portion of the cavity can have a sufficiently small volume. Therefore, in the first cavity portion, radial propagation of plasma can be restrained, whereby the discharge speed of plasma along the direction of the axis can be further increased. As a result, the discharge length of plasma from the opening of the cavity can be further increased, whereby ignition performance can be further improved.

Configuration 3:

A plasma jet ignition plug of the present configuration is characterized in that, in the above configuration 1 or 2, the first straight portion has a length of 0.5 mm or less along the axis.

At the time of spark discharge, charges may collide against the diameter-reducing portion. However, according to the above configuration 3, the first straight portion has a relatively small length of 0.5 mm or less along the axis. Therefore, energy of collision of charges against the diameter-reducing portion can be effectively reduced. As a result, channeling can be more reliably restrained, and thus excellent ignition performance can be maintained over a longer period of time.

Configuration 4:

A plasma jet ignition plug of the present configuration is characterized in that, in any one of the above configurations 1 to 3, a shortest distance as measured along an inner circumferential surface of the insulator between an opening of the cavity and an imaginary plane which is orthogonal to the direction of the axis and which contains the forward end of the center electrode is 1.0 mm or more.

When the center electrode wears in association with generation of plasma, wear particles adhere to the inner circumferential surface of the insulator. Accordingly, insulation resistance between the center electrode and the ground electrode may drop. When insulation resistance between the center electrode and the ground electrode becomes excessively low, current is apt to leak therebetween, potentially resulting in hindrance to generation of spark discharge and in turn, hindrance to generation of plasma.

In this regard, according to the above configuration 4, the shortest distance as measured along the inner circumferential surface of the insulator between the opening of the cavity and an imaginary plane which is orthogonal to the axis and which contains the forward end of the center electrode is specified as a sufficiently large value of 1.0 mm or more. Therefore, even when some wear particles adhere to the inner circumferential surface of the insulator, sufficient insulation performance can be maintained between the center electrode and the ground electrode. As a result, leakage of current can be more reliably prevented, and in turn, actions and effects peculiar to the above configuration 1, etc., can be more reliably exhibited.

Configuration 5:

A plasma jet ignition plug of the present configuration is characterized in that, in any one of the above configurations 1 to 4, the ground electrode is in contact with a forward end surface of the insulator, and a shortest distance as measured along the inner circumferential surface of the insulator between the ground electrode and the imaginary plane which is orthogonal to the direction of the axis and which contains the forward end of the center electrode is 2.5 mm or less.

In view that discharge voltage increases gradually with erosion of the center electrode and that the higher the discharge voltage, the greater the extent of channeling that is likely to arise on the insulator, desirably, discharge voltage at an early stage of use (before the center electrode, etc. are eroded) is relatively low.

In this regard, according to the above configuration 5, the shortest distance as measured along the inner circumferential surface of the insulator between the imaginary plane and the ground electrode is specified as 2.5 mm or less. Therefore, discharge voltage at an early stage of use can be restrained to a relatively low level, whereby discharge abnormality and progress of channeling associated with an increase in discharge voltage can be more reliably prevented.

Configuration 6:

A plasma jet ignition plug of the present configuration is characterized in that, in any one of the above configurations 1 to 5, the axial bore has a second straight portion having a fixed inside diameter and extending from a forward end of the diameter-reducing portion to the opening of the cavity, and a relational expression $0.2 \leq V2/V1 \leq 3.0$ is satisfied, where V1 ($mm^3$) is a volume of a first cavity portion whose circumference is defined by the first straight portion and the diameter-reducing portion, and V2 ($mm^3$) is a volume of a second cavity portion whose circumference is defined by the second straight portion.

According to the above configuration 6, the volume V1 of the first cavity portion and the volume V2 of the second cavity portion satisfy the relational expression $0.2 \leq V2/V1 \leq 3.0$. Through satisfaction of the relational expression $0.2 \leq V2/V1$, while the first cavity portion has a relatively small capacity, a certain magnitude of volume is ensured for the second cavity portion. That is, when the volume V1 of the first cavity portion is excessively large, there is concern about a drop in discharge pressure for discharging plasma generated in the second cavity portion from the opening of the cavity. However, by means of the first cavity portion having a relatively small volume V1, the first cavity portion can be filled with plasma generated therein, whereby plasma discharge pressure can be sufficiently high. Also, by means of ensuring a certain magnitude of volume V2 for the second cavity portion, plasma to be discharged from the opening of the cavity with discharge pressure generated in the first cavity portion can be sufficiently generated, whereby larger plasma can be discharged from the opening of the cavity.

Furthermore, through satisfaction of the relational expression $V2/V1 \leq 3.0$, the volume V2 of the second cavity portion does not become excessively large in relation to the volume V1 of the first cavity portion. Thus, there can be more reliably prevented a situation in which plasma is excessively generated in the second cavity portion with a resultant failure to sufficiently discharge plasma with discharge pressure generated in the first cavity portion, whereby the amount of discharge of plasma from the opening of the cavity can be increased.

As mentioned above, according to the above configuration 6, the relational expression $0.2 \leq V2/V1 \leq 3.0$ is satisfied, whereby the discharge force and discharge amount of plasma can be further increased, so that ignition performance can be further improved.

Configuration 7:

A plasma jet ignition plug of the present configuration is characterized in that, in any one of the above configurations 1 to 6, the ground electrode assumes a plate-like form and has a through-hole extending therethrough in a plate thickness direction, and as viewed on an imaginary plane which is orthogonal to the axis and onto which are projected an opening of the insulator, an outer circumference of the forward end surface of the center electrode, and an inner circumference of the ground electrode along the direction of the axis, a projected line of the inner circumference of the ground electrode is located between a projected line of the opening of the insulator and a projected line of the outer circumference of the forward end surface of the center electrode.

According to the above configuration 7, the ground electrode does not overlap the opening of the cavity. Therefore, discharge of plasma is less likely to be hindered by the ground electrode, and transfer of heat of plasma to the ground electrode can be more reliably prevented. As a result, growth of plasma can be promoted, whereby ignition performance can be further improved.

Meanwhile, when configuration is such that the ground electrode does not overlap the opening of the cavity, spark discharge is generated between the outer circumference of the forward end surface of the center electrode and the wall of the through-hole of the ground electrode in such a manner as to turn around the opening of the cavity. That is, spark discharge is generated along such a path as to be pulled by the ground electrode. As a result, spark discharge may be pressed more strongly against the inner circumferential surface of the insulator.

In this regard, according to the above configuration 7, as viewed on the imaginary plane, the projected region of the through-hole of the ground electrode is contained in the projected region of the center electrode; i.e., the wall of the through-hole of the ground electrode is located inside the outer circumference of the forward end surface of the center electrode, the outer circumference being a starting point of spark discharge. That is, according to the above configuration 7, spark discharge is generated along a path closer to a straight line which connects the outer circumference of the forward end surface of the center electrode and the wall of the through-hole of the ground electrode, and spark discharge generated along this path is weakest in pressing against the inner circumferential surface of the insulator. Therefore, pressing of spark discharge against the inner circumferential surface of the insulator can be effectively weakened, and in turn, channeling can be more reliably restrained.

Configuration 8:

A plasma jet ignition plug of the present configuration is characterized in that, in any one of the above configurations 1 to 7, a portion of the center electrode which extends 0.3 mm rearward with respect to the direction of the axis from the forward end of the center electrode is formed from a metal which contains at least one of tungsten (W), iridium (Ir), platinum (Pt), and nickel (Ni).

According to the above configuration 8, a forward end portion of the center electrode is formed from a metal which contains at least one of W, Ir, etc. Thus, erosion resistance of the center electrode to spark discharge, etc., can be improved, and in turn, the increase in speed of discharge voltage associated with erosion of the center electrode can be restrained. As a result, a period of time during which spark discharge and in turn plasma can be generated can be further elongated, and channeling can be further restrained.

Configuration 9:

A plasma jet ignition plug of the present configuration is characterized in that, in any one of the above configurations 1 to 8, the ground electrode is formed from a metal which contains at least one of W, Ir, Pt, and Ni.

According to the above configuration 9, the ground electrode is formed from a metal which contains at least one of W, Ir, etc. Therefore, erosion resistance of the ground electrode to spark discharge, etc., can be improved. As a result, an increase in discharge voltage in association with erosion of the ground electrode can be restrained, and resistance to channeling can be further improved.

DETAIL DESCRIPTION OF THE INVENTION

Figure 1:
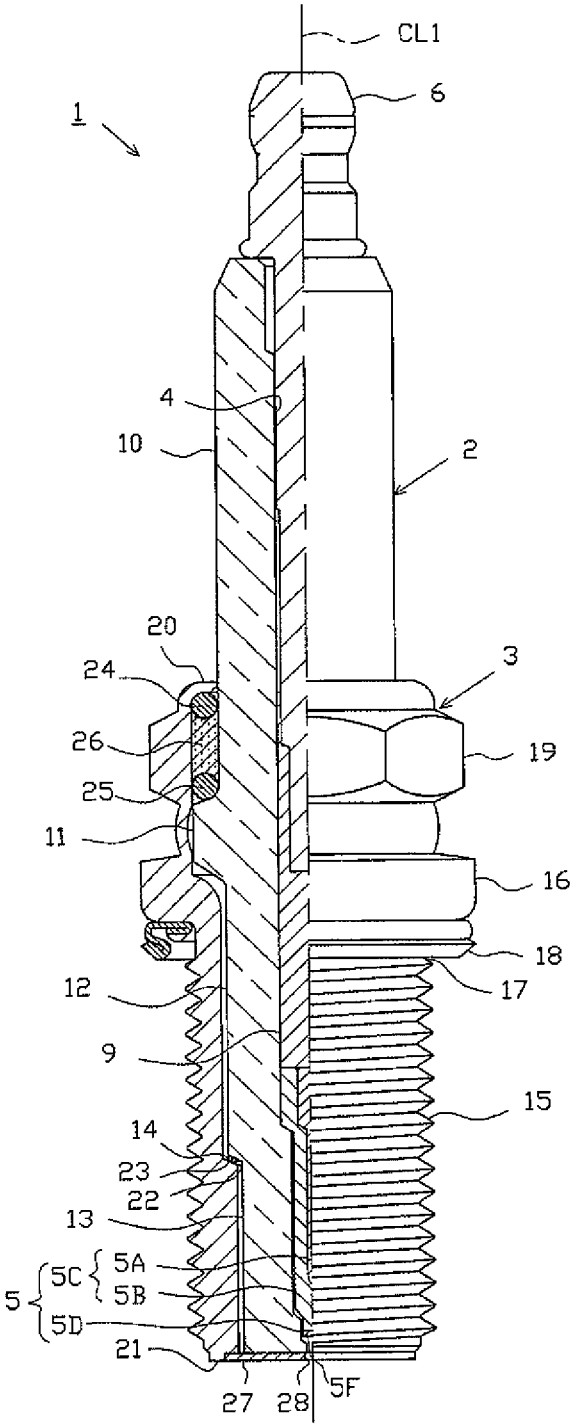
FIG. 1 is a partially cutaway front view showing the configuration of a plasma jet ignition plug.

An embodiment of the present invention will next be described with reference to the drawings. FIG. 1 is a partially cutaway front view showing a plasma jet ignition plug (hereinafter, referred to as the "ignition plug") 1. In the following description, the direction of an axis CL1 of the ignition plug 1 in FIG. 1 is referred to as the vertical direction, and the lower side of the ignition plug 1 in FIG. 1 is referred to as the forward side of the ignition plug 1, and the upper side as the rear side of the ignition plug 1.

The ignition plug 1 includes a tubular insulator 2, which corresponds to the insulator of the present invention, and a tubular metallic shell 3, which holds the insulator 2 therein.

The ceramic insulator 2 is formed from alumina or the like by firing, as well known in the art. The ceramic insulator 2, as viewed externally, includes a rear trunk portion 10 formed on the rear side; a large-diameter portion 11, which is located forward of the rear trunk portion 10 and projects radially outward; an intermediate trunk portion 12, which is located forward of the large-diameter portion 11 and is smaller in diameter than the large-diameter portion 11; and a leg portion 13, which is located forward of the intermediate trunk portion 12 and is smaller in diameter than the intermediate trunk portion 12. Additionally, the large-diameter portion 11, the intermediate trunk portion 12, and the leg portion 13 of the ceramic insulator 2 are accommodated within the metallic shell 3. A stepped portion 14 is formed at a connection portion between the intermediate trunk portion 12 and the leg portion 13. The ceramic insulator 2 is seated on the metallic shell 3 at the stepped portion 14.

Furthermore, the ceramic insulator 2 has an axial bore 4 extending therethrough along the axis CL1. A center electrode 5 is fixedly inserted into a forward end portion of the axial bore 4. The center electrode 5 includes a base metal 5C composed of an inner layer 5A made of, for example, copper or a copper alloy, which has excellent thermal conductivity, and an outer layer 5B made of a nickel (Ni) alloy (e.g. INCONEL (trade name) 600 or 610) which contains Ni as a main component; and an electrode tip 5D joined to the forward end of the base metal 5C. Furthermore, the center electrode 5 assumes a rodlike (circular columnar) shape as a whole, and its forward end surface 5F is flat. Additionally, the forward end surface 5F is retracted rearward from the forward end surface of the ceramic insulator 2. In the present embodiment, in view of dimensional errors or the like involved in the course of manufacture, some gap is formed between the outer circumferential surface of a forward end portion of the center electrode 5 and the inner circumferential surface of the axial bore 4.

Also, a terminal electrode 6 is fixedly inserted into a rear end portion of the axial bore 4 and projects from the rear end of the ceramic insulator 2.

Furthermore, a circular columnar glass seal layer 9 is disposed within the axial bore 4 between the center electrode 5 and the terminal electrode 6. The center electrode 5 and the terminal electrode 6 are electrically connected to each other via the glass seal layer 9.

Additionally, the metallic shell 3 is formed into a tubular shape from a low-carbon steel or a like metal. The metallic shell 3 has, on its outer circumferential surface, a threaded portion (externally threaded portion) 15 adapted to mount the ignition plug 1 into a mounting hole of a combustion apparatus (e.g., an internal combustion engine or a fuel cell reformer). Also, the metallic shell 3 has, on its outer circumferential surface, a seat portion 16 located rearward of the threaded portion 15. A ring-like gasket 18 is fitted to a screw neck 17 at the rear end of the threaded portion 15. Furthermore, the metallic shell 3 has, near the rear end thereof, a tool engagement portion 19 having a hexagonal cross section and allowing a tool, such as a wrench, to be engaged therewith when the metallic shell 3 is to be mounted to the combustion apparatus. Also, the metallic shell 3 has a crimp portion 20 provided at a rear end portion thereof for retaining the ceramic insulator 2. In addition, the metallic shell 3 has an annular engagement portion 21 formed externally at a forward end portion thereof and projecting forward with respect to the direction of the axis CL1. The ground electrode 27, which will be described later, is joined to the engagement portion 21.

Also, the metallic shell 3 has, on its inner circumferential surface, a tapered, stepped portion 22 adapted to allow the ceramic insulator 2 to be seated thereon. The ceramic insulator 2 is inserted forward into the metallic shell 3 from the rear end of the metallic shell 3. In a state in which the stepped portion 14 of the ceramic insulator 2 butts against the stepped portion 22 of the metallic shell 3, a rear-end opening portion of the metallic shell 3 is crimped radially inward; i.e., the crimp portion 20 is formed, whereby the ceramic insulator 2 is fixed to the metallic shell 3. An annular sheet packing 23 intervenes between the stepped portions 14 and 22 of the ceramic insulator 2 and the metallic shell 3, respectively. This retains gastightness of a combustion chamber and prevents outward leakage of fuel gas through a clearance between the leg portion 13 of the ceramic insulator 2 and the inner circumferential surface of the metallic shell 3.

Furthermore, in order to ensure gastightness which is established by crimping, annular ring members 24 and 25 intervene between the metallic shell 3 and the ceramic insulator 2 in a region near the rear end of the metallic shell 3, and a space between the ring members 24 and 25 is filled with a powder of talc 26. That is, the metallic shell 3 holds the ceramic insulator 2 via the sheet packing 23, the ring members 24 and 25, and the talc 26.

The ground electrode 27 assuming the form of a disk (e.g., a thickness of 0.3 mm to 1.0 mm) is joined to a forward end portion of the metallic shell 3. The ground electrode 27 is joined to the metallic shell 3 as follows: while the ground electrode 27 is engaged with the engagement portion 21 of the metallic shell 3, an outer circumferential portion of the ground electrode 27 is welded to the engagement portion 21. Also, the ground electrode 27 has a through-hole 28 formed at its center and extending therethrough in the thickness direction. The interior of a cavity 29, which will be described later, communicates with an ambient atmosphere via the through-hole 28. In the present embodiment, the ground electrode 27 is joined such that the through-hole 28 and the axial bore 4 are coaxially located (i.e., the center of the through-hole 28 is located on the axis CL1). Also, the ground electrode 27 is in surface contact with the forward end surface of the ceramic insulator 2.

Figure 2:
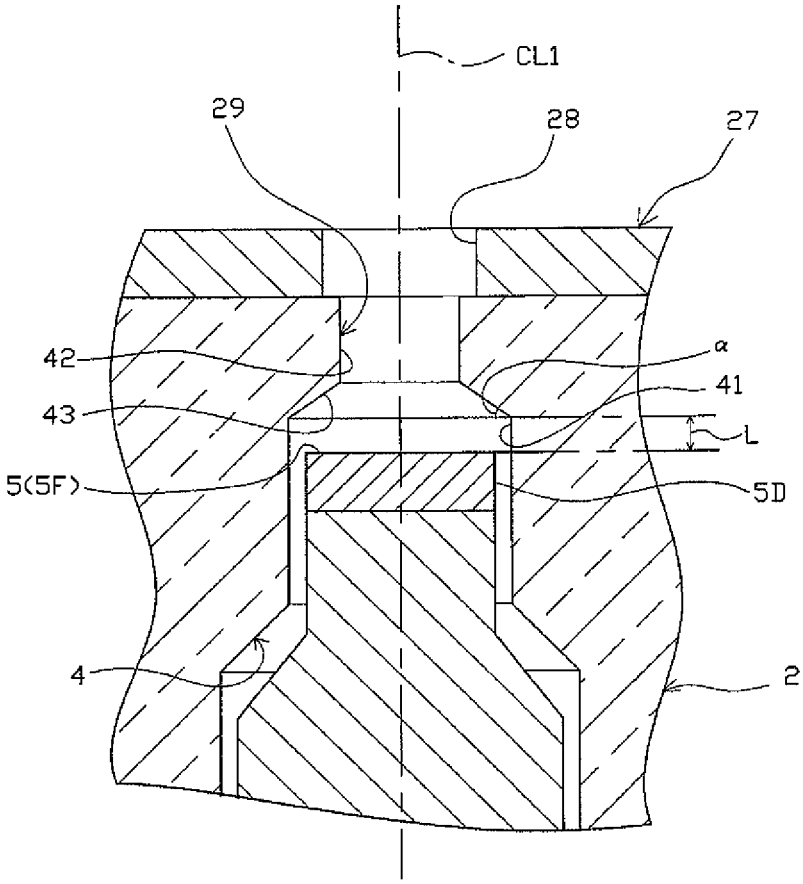
FIG. 2 is a fragmentary, enlarged sectional view showing the configuration of an axial bore, etc.

Additionally, as shown in FIG. 2, the ceramic insulator 2 has, at its forward end portion, the cavity 29 defined by the inner circumferential surface of the axial bore 4 and the forward end surface of the center electrode 5. The cavity 29 is a space which has a circular cross section taken orthogonally to the axis CL1, and opens forward.

Next, the configuration, etc., of the axial bore 4, which is a feature portion of the present embodiment, will be described in detail.

In the present embodiment, the axial bore 4 has a first straight portion 41, a second straight portion 42, and a diameter-reducing portion 43.

The first straight portion 41 extends forward with respect to the direction of the axis CL1 from the forward end surface of the center electrode 5 and has a fixed inside diameter (e.g., 1 mm to 2 mm). The second straight portion 42 extends rearward with respect to the direction of the axis CL1 from the opening of the cavity 29 and has a fixed inside diameter. Additionally, the second straight portion 42 has a diameter (e.g., 0.5 mm to 1 mm) smaller than that of the first straight portion 41. The inside diameter of the first straight portion 41 and the inside diameter of the second straight portion 42 may be slightly increased or decreased along the axis CL1. Therefore, the inner circumferential surfaces of the first straight portion 41 and the second straight portion 42 may be slightly (e.g., within ±5°) inclined from the axis CL1.

Also, the diameter-reducing portion 43 is provided between the first straight portion 41 and the second straight portion 42 and is tapered such that diameter reduces forward with respect to the direction of the axis CL1. In the present embodiment, the diameter-reducing portion 43 is configured such that as viewed on a section which contains the axis CL1, the relational expression $10 \leq \alpha \leq 45$ is satisfied, where $\alpha$ (°) is an acute angle formed by a straight line orthogonal to the axis CL1 and the outline of the diameter-reducing portion 43.

Figure 3:
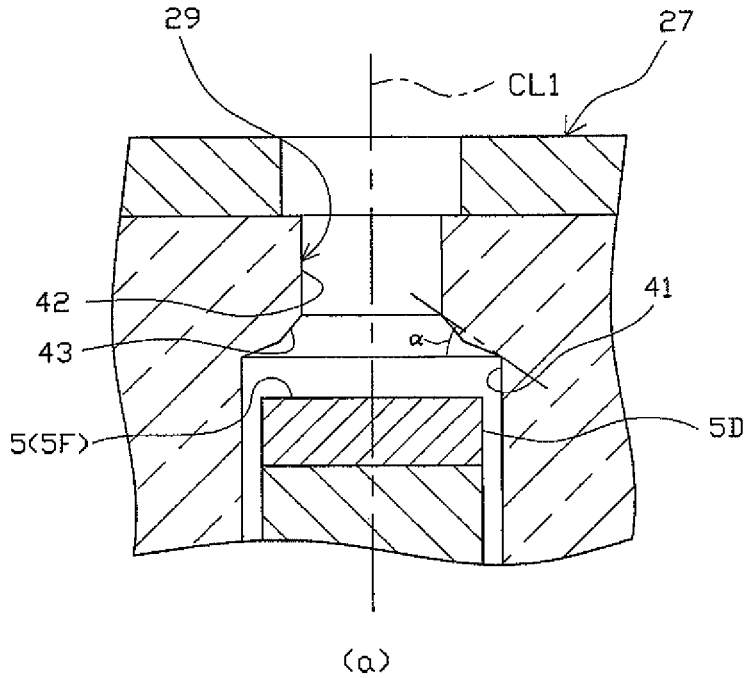
FIGS. 3(*a*) and 3(*b*) are fragmentary, enlarged sectional views showing modified diameter-reducing portions.
Figure 3:
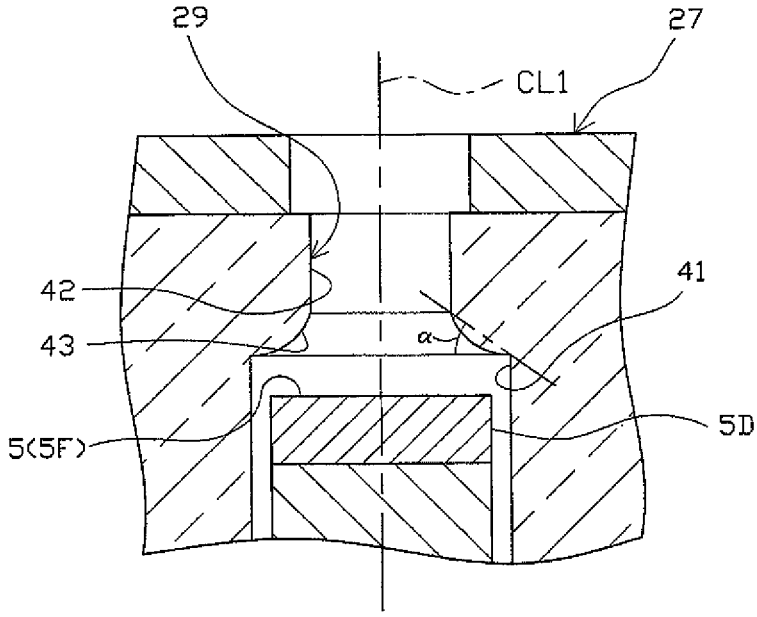

The shape of the diameter-reducing portion 43 is not limited to the above-mentioned shape. As shown in FIG. 3(*a*), as viewed on the section which contains the axis CL1, the diameter-reducing portion 43 may be configured to have a bent outline. Also, as shown in FIG. 3(*b*), the diameter-reducing portion 43 may be configured to have a curved outline. In these cases, the angle $\alpha$ is an acute angle formed by a straight line orthogonal to the axis CL1 and a straight line which connects the forward end of the first straight portion 41 and the rear end of the second straight portion 42.

Referring back to FIG. 2, in the present embodiment, the length L of the first straight portion 41 along the axis CL1 is set to a relatively small value of 0.1 mm to 0.5 mm. Also, the length of the second straight portion 42 (e.g., 0.5 mm to 2 mm) along the axis CL1 is set equal to or greater than the length L of the first straight portion 41.

Figure 4:
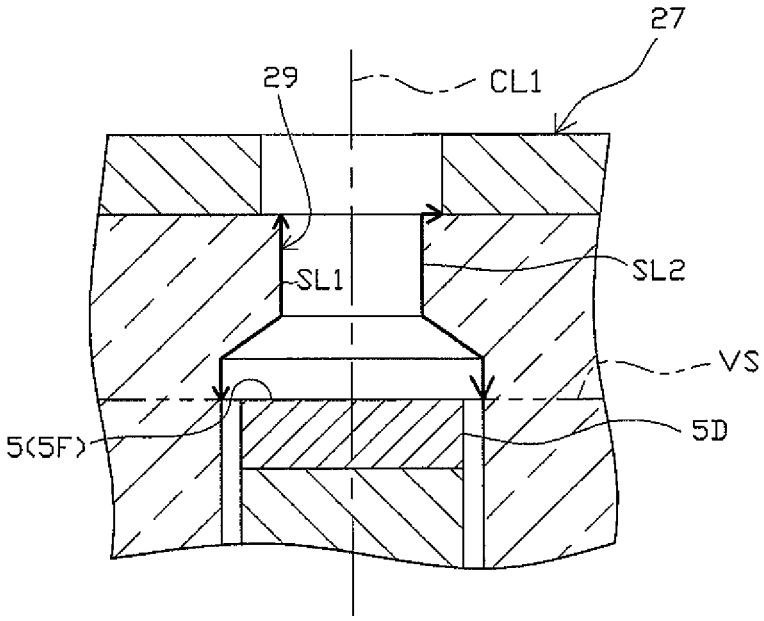
FIG. 4 is a fragmentary, enlarged sectional view for explaining the shortest distances SL1 and SL2, etc.

Furthermore, as shown in FIG. 4, a shortest distance SL1 as measured along the inner circumferential surface of the insulator 2 between the opening of the cavity 29 and an imaginary plane VS which is orthogonal to the direction of the axis CL1 and which contains the forward end of the center electrode 5 is 1.0 mm or more, so that a sufficiently large gap is formed between the center electrode 5 and the ground electrode 27. Meanwhile, in order to prevent an increase in discharge voltage, a shortest distance SL2 as measured along the inner circumferential surface of the insulator 2 between the imaginary plane VS and the ground electrode 27 is 2.5 mm or less.

Figure 5:
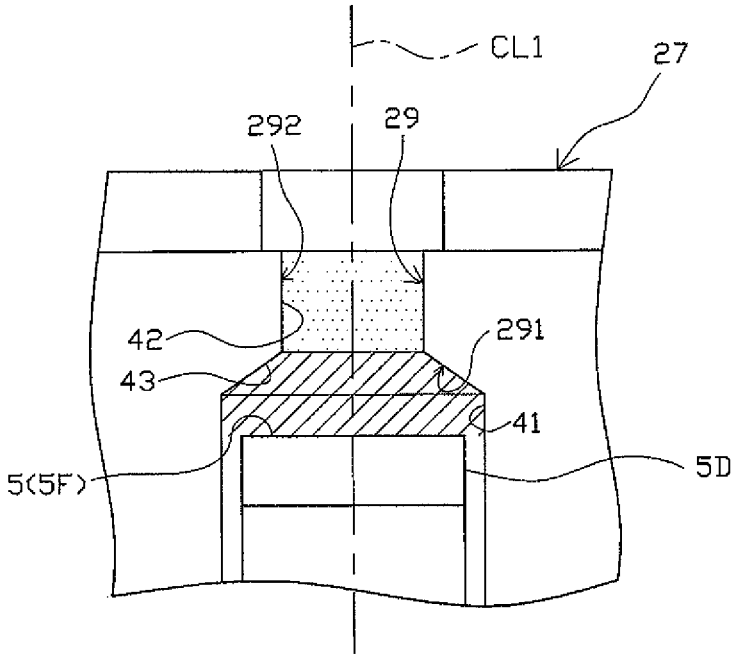
FIG. 5 is an enlarged sectional schematic view for explaining a first cavity portion and a second cavity portion.

In addition, as shown in FIG. 5 (in FIG. 5, for convenience of illustration, hatching the center electrode 5, the ceramic insulator 2, etc., is omitted), the relational expression $0.2 \leq V2/V1 \leq 3.0$ is satisfied, where V1 ($mm^3$) is the volume of a first cavity portion 291 (hatched in FIG. 5) whose circumference is defined by the first straight portion 41 and the diameter-reducing portion 43, and V2 ($mm^3$) is the volume of a second cavity portion 292 (dotted in FIG. 5) whose circumference is defined by the second straight portion 42.

Figure 6:
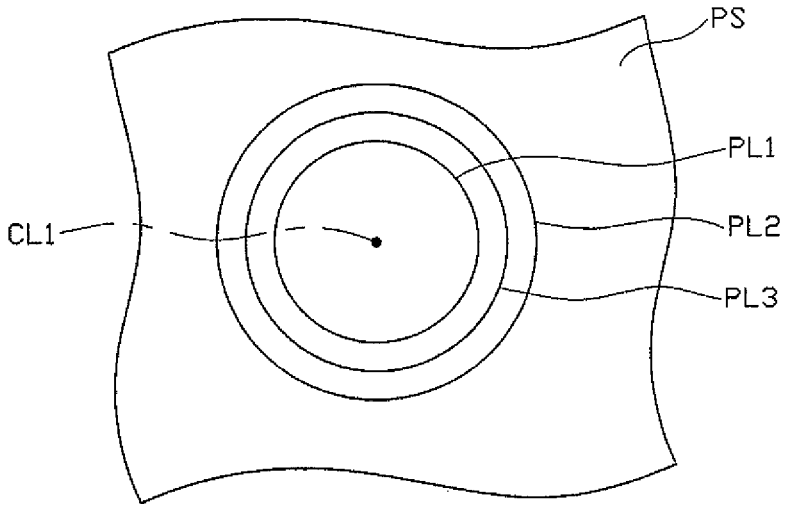
FIG. 6 is a projection view showing projected lines, such as the projected line of the forward end surface of the center electrode, as viewed on an imaginary plane of projection.

Furthermore, the center electrode 5, the ground electrode 27, and the cavity 29 are disposed in such a manner as to satisfy the following positional relation. As shown in FIG. 6, as viewed on an imaginary plane PS which is orthogonal to the axis CL1 and onto which are projected, along the axis CL1, the opening of the ceramic insulator 2 (the opening of the cavity 29), the outer circumference of the forward end surface 5F of the center electrode 5, and the inner circumference (the inner circumference of the through-hole 28) of the ground electrode 27, a projected line PL3 of the inner circumference of the ground electrode 27 is located between a projected line PL1 of the opening of the ceramic insulator 2 and a projected line PL2 of the outer circumference of the forward end surface 5F.

Additionally, the electrode tip 5D constitutes a portion of the center electrode 5 which extends 0.3 mm rearward with respect to the direction of the axis CL1 from the forward end of the center electrode 5 and is formed from a metal which contains at least one of tungsten (W), iridium (Ir), platinum (Pt), and nickel (Ni).

Similar to the electrode tip 5D, the ground electrode 27 is formed from a metal which contains at least one of W, Ir, Pt, and Ni.

As described above in detail, according to the present embodiment, the axial bore 4 has the diameter-reducing portion 43 whose diameter reduces forward with respect to the direction of the axis CL1. Therefore, plasma discharge pressure directed toward the opening of the cavity 29 can be increased. As a result, the discharge length of plasma from the opening of the cavity 29 can be further increased, whereby ignition performance can be improved.

Meanwhile, provision of the diameter-reducing portion 43 involves concern about an abrupt increase in the volume of the cavity 29 or a like problem. However, in the present embodiment, the angle $\alpha$ is specified as 10° or more. Thus, the diameter-reducing portion 43 is formed in such a manner as to follow the direction of spark discharge to the greatest possible extent without assuming a state of being orthogonal to the direction of spark discharge. Therefore, there can be more reliably restrained a situation in which spark discharge is generated while being excessively pressed against the diameter-reducing portion 43, so that rapid progress of channeling can be reliably prevented.

Furthermore, in the present embodiment, the first straight portion 41 is provided between the forward end surface 5F of the center electrode 5 and the diameter-reducing portion 43. Thus, the forward end surface 5F of the center electrode 5 and a bend formed between the first straight portion 41 and the diameter-reducing portion 43 are spaced apart from each other with respect to the direction of the axis CL1. Therefore, there can be more effectively prevented a situation in which spark discharge is intensively generated along a path which passes through the bend, whereby a spark discharge path can be more dispersed. As a result, coupled with the effect of an angle α of 10° or more, rapid progress of channeling can be quite effectively prevented.

As mentioned above, according to the present embodiment, by means of the first straight portion 41 being provided while the angle α is 10° or more, the demerit of rapid progress of channeling associated with provision of the diameter-reducing portion 43 can be effectively solved, and the merit of improving ignition performance associated with provision of the diameter-reducing portion 43 can be maintained over a long period of time.

Also, since the angle α is specified as 45° or less, the first cavity portion 291 can have a sufficiently small volume. Therefore, in the first cavity portion 291, radial propagation of plasma can be restrained, whereby the discharge speed of plasma along the direction of the axis CL1 can be further increased. As a result, the discharge length of plasma from the opening of the cavity 29 can be further increased, whereby ignition performance can be further improved.

Furthermore, the first straight portion 41 has a relatively small length L of 0.5 mm or less along the axis CL1. Therefore, energy of collision of charges against the diameter-reducing portion 43 can be effectively reduced. As a result, channeling can be more reliably restrained, and thus excellent ignition performance can be maintained over a longer period of time.

Additionally, the shortest distance SL1 as measured along the inner circumferential surface of the ceramic insulator 2 between the imaginary plane VS and the opening of the cavity 29 is specified as a sufficiently large value of 1.0 mm or more. Therefore, even when some wear particles adhere to the inner circumferential surface of the ceramic insulator 2, sufficient insulation performance can be maintained between the center electrode 5 and the ground electrode 27. As a result, leakage of current can be more reliably prevented, and in turn, the above-mentioned actions and effects can be more reliably exhibited.

Meanwhile, since the shortest distance SL2 as measured along the inner circumferential surface of the ceramic insulator 2 between the imaginary plane VS and the ground electrode 27 is specified as 2.5 mm or less, discharge voltage at an early stage of use can be restrained to a relatively low level. As a result, discharge abnormality and progress of channeling associated with an increase in discharge voltage can be more reliably prevented.

Also, the volume V1 of the first cavity portion 291 and the volume V2 of the second cavity portion 292 satisfy the relational expression $0.2 \leq V2/V1 \leq 3.0$. Therefore, the discharge force and discharge amount of plasma can be further increased, so that ignition performance can be further improved.

Furthermore, a forward end portion (the electrode tip 5D) of the center electrode 5, and the ground electrode 27 are formed from a metal which contains at least one of W, Ir, etc. Thus, erosion resistance of the center electrode 5 and the ground electrode 27 to spark discharge, etc., can be improved, and thus, an increase in discharge voltage in association with erosion of the center electrode 5, etc., can be restrained. As a result, a period of time during which spark discharge and in turn plasma can be generated can be further elongated, and channeling can be further restrained.

Next, in order to verify actions and effects to be yielded by the above embodiment, there were manufactured a plurality of ignition plug samples which had the diameter-reducing portion and differed in the angle α. The samples were subjected to a durability evaluation test and an ignition performance evaluation test.

Figure 7:
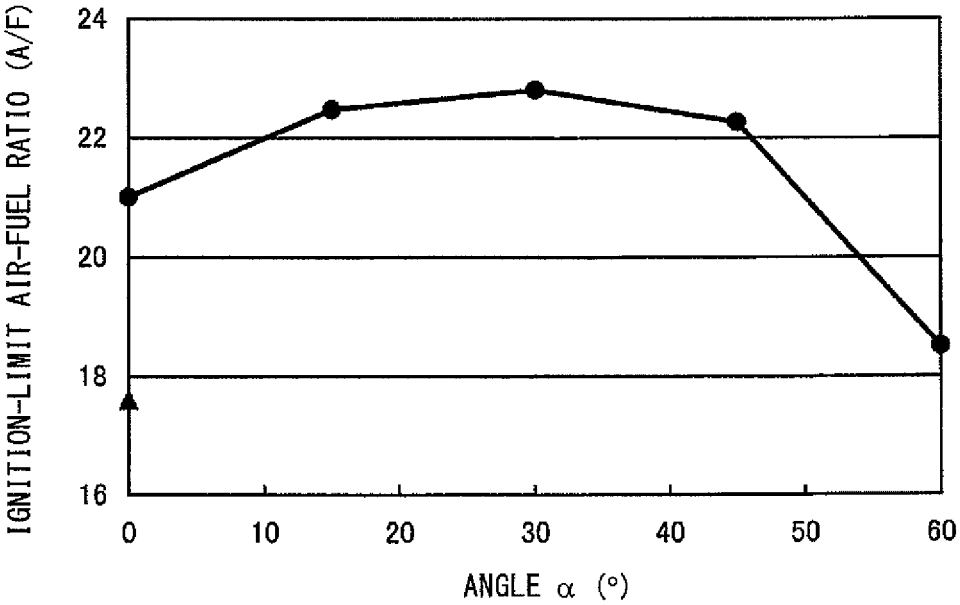
FIG. 7 is a graph showing the results of an ignition performance evaluation test conducted on samples which differ in angle α.
Figure 9:
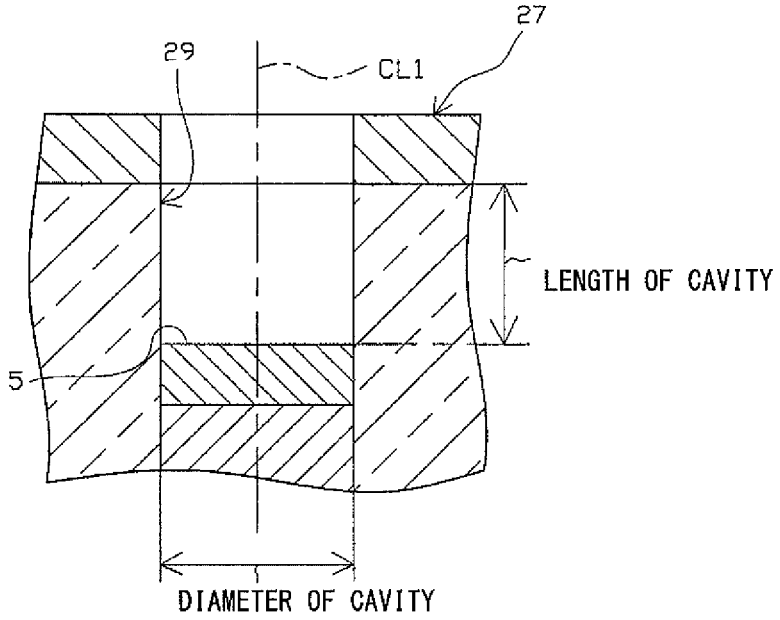
FIG. 9 is a fragmentary, enlarged sectional view showing the cavity, etc., of a sample of a comparative example.

The ignition performance evaluation test is briefly described below. The samples were mounted to a 4-cylinder engine of 2.0 L displacement. The engine was operated at a speed of 1,600 rpm through generation of spark discharges with ignition timing set to MBT (Minimum Spark Advance for Best Torque) and generation of plasma by application of power from a plasma power supply having an output of 100 mJ. While the air-fuel ratio was being increased (the fuel content was being reduced), the variation rate of engine torque was measured in relation to the air-fuel ratio. An air-fuel ratio at which the variation rate of engine torque exceeded 5% was obtained as a limit air-fuel ratio. The higher the limit air-fuel ratio, the better the ignition performance. In FIG. 7, the results of the test are plotted with circles. Also, in FIG. 7, the test result of an ignition plug of a comparative example having a circular columnar cavity (see FIG. 9) is plotted with a triangle.

Figure 8:
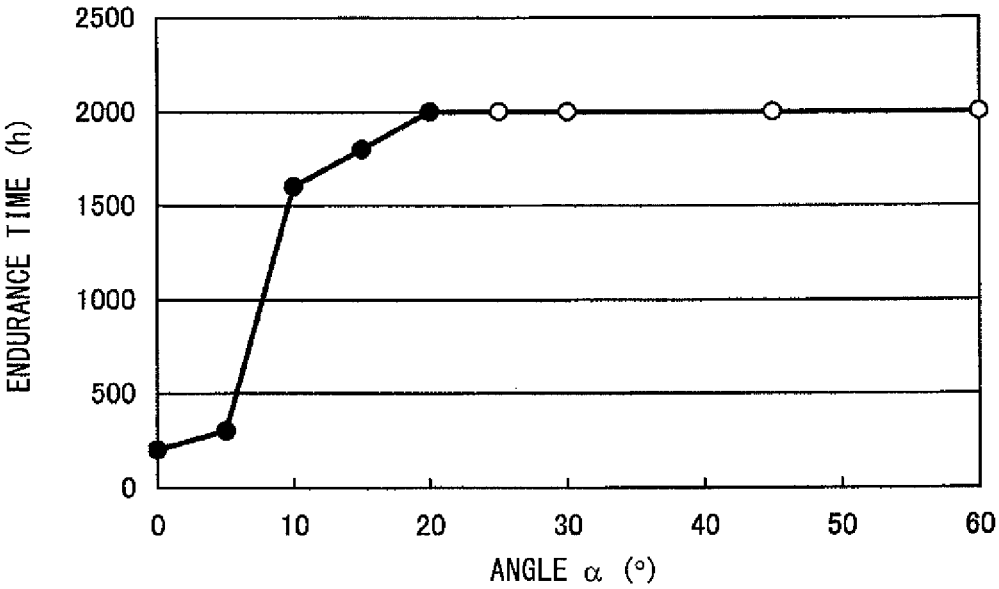
FIG. 8 is a graph showing the results of a durability evaluation test conducted on samples which differ in angle α.

The durability evaluation test is briefly described below. First, plasma was discharged through application of power to each of the samples, and the plasma discharged from the side of the sample was image-captured. From the captured image of plasma, the discharge area of the plasma in an initial state was measured. Subsequently, the samples were mounted to a predetermined chamber. The samples were caused to discharge at a chamber pressure of 0.4 MPa and a frequency of applied voltage of 60 Hz (i.e., the samples discharged 3,600 times per minute) (at this time, power from a plasma power supply was not applied, and only spark discharges were generated). Next, plasma was discharged at 100-hour intervals through application of current from the plasma power supply, and the plasma discharged from the side of the sample was image-captured. From the captured image of plasma, the discharge area of the plasma was measured. The elapse of time (endurance time) when the measured discharge area of plasma became half or less of the discharge area of plasma in the initial state was obtained. FIG. 8 shows the results of the test. Voltage was applied to the samples for up to 2,000 hours. For the samples whose discharge areas of plasmas as measured after the elapse of 2,000 hours were in excess of half of the respective discharge areas of plasmas in the initial state, the test results are plotted with outlined circles in FIG. 8.

Figure 10:
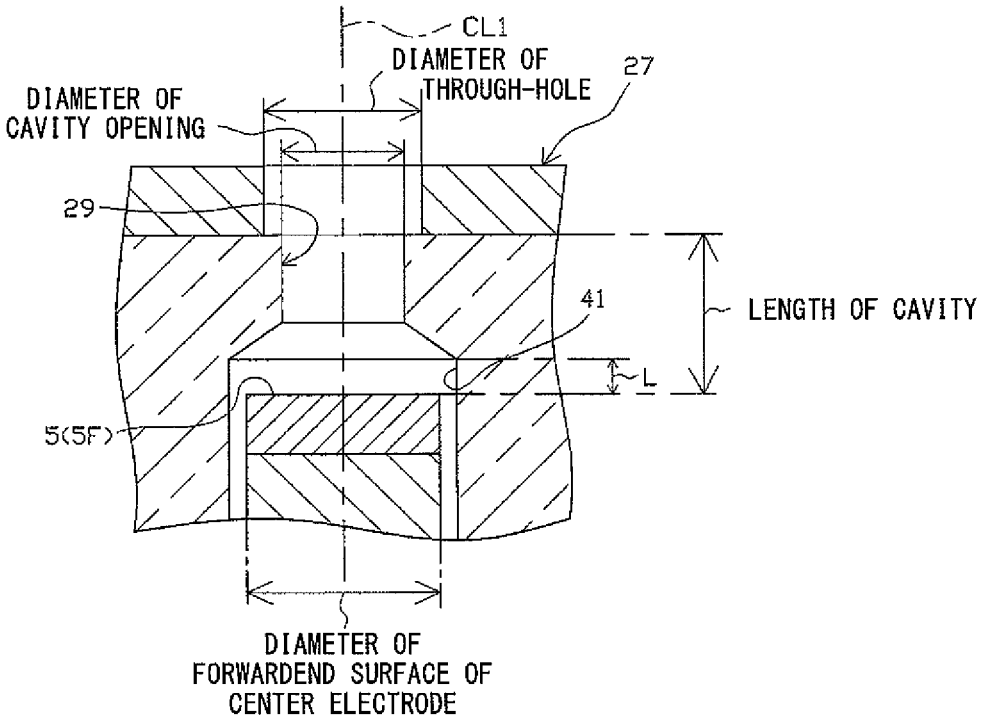
FIG. 10 is a fragmentary, enlarged sectional view showing the cavity, etc., of a sample of an example.

Referring to FIG. 10, the samples had a length L of the first straight portion along the axis of 0.1 mm and a length of the cavity along the axis (a distance along the axis from the opening of the cavity to the forward end of the center electrode) of 1.0 mm. Furthermore, the outside diameter of the forward end surface of the center electrode was 1.5 mm; the inside diameter of the opening of the cavity was 0.8 mm; and the inside diameter of the through-hole of the ground electrode was 1.0 mm. Meanwhile, the ignition plug of the comparative example having a circular columnar cavity had a length of the cavity along the axis of 1.0 mm and an inside diameter of the cavity of 1.5 min.

As is apparent from FIG. 7, the samples having the respective diameter-reducing portions are superior in ignition performance to the ignition plug of the comparative example having the circular columnar cavity. Conceivably, this is for the following reason: through provision of the diameter-reducing portion, plasma discharge pressure directed toward the opening of the cavity (directed forward with respect to the axial direction) was able to be increased. As a result, the discharge length of plasma from the opening of the cavity was able to be further increased. Particularly, it has been confirmed that the samples having an angle α of 45° or less have quite excellent ignition performance.

Meanwhile, as shown in FIG. 8, even though the diameter-reducing portion is provided, the samples having an angle α of less than 10° are short in endurance time, indicating rapid deterioration in ignition performance in the course of use. Conceivably, this is for the following reason: spark discharge is generated between the center electrode and the ground electrode in a direction substantially along the axis. However, as a result of the angle α being excessively small such that the diameter-reducing portion was shaped in such a manner as to be substantially orthogonal to the direction of spark discharge, spark discharge was strongly pressed against the diameter-reducing portion, and in turn, channeling was likely to arise.

By contrast, the samples having an angle α of 10° or more exhibit an endurance time in excess of 1,500 hours, indicating that the samples can maintain excellent ignition performance over a long period of time. Particularly, the samples having an angle α of 20° or more exhibit an endurance time of 2,000 hours or more, indicating that the samples can maintain excellent ignition performance over a very long period of time.

Figure 11:
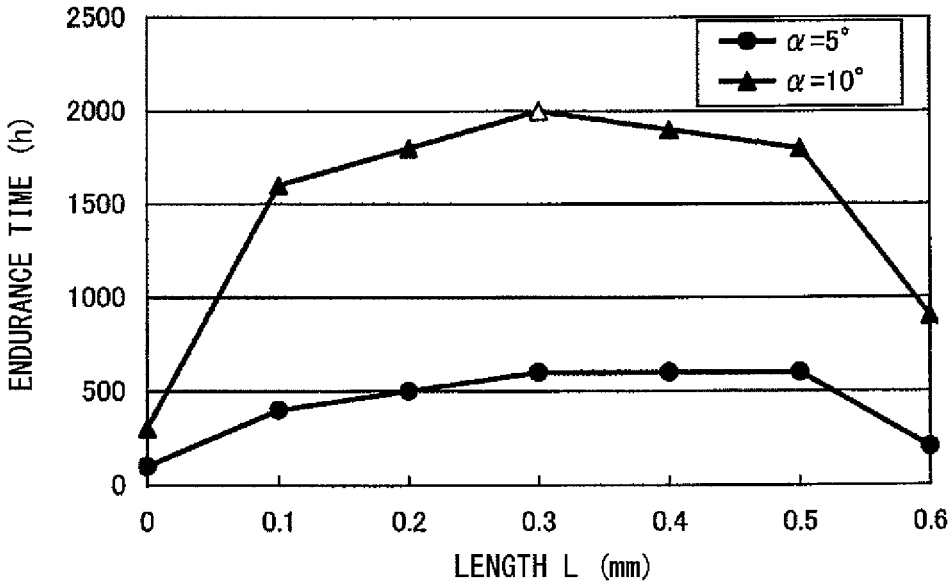
FIG. 11 is a graph showing the results of the durability evaluation test conducted on samples which differ in the length L of a first straight portion.

Next, there were manufactured ignition plug samples which had an angle α of 5° or 10° and did not have the first straight portion (i.e., the first straight portion had a length L of 0.0 mm, so that the forward end corner of the center electrode and the bend at the rear end of the diameter-reducing portion faced each other along a direction orthogonal to the axis), and ignition plug samples which had respective first straight portions and differed in the length L of the first straight portion along the axis. The samples were subjected to the above-mentioned durability evaluation test. FIG. 11 shows the results of the test. In FIG. 11, the test results of the samples having an angle α of 5° are plotted with circles, whereas the test results of the samples having an angle α of 10° are plotted with triangles. In the samples, the outside diameter of the forward end surface of the center electrode, the inside diameter of the opening of the cavity, etc., were as mentioned above.

As is apparent from FIG. 11, the samples in which the first straight portion has a certain length L are superior in durability to the samples in which the first straight portion is not provided (the length L is 0.0 mm). Conceivably, this is for the following reason: by means of the forward end surface of the center electrode and a bend formed between the first straight portion and the diameter-reducing portion being spaced apart from each other, there was restrained a situation in which spark discharge is intensively generated between the bend and the forward end corner of the center electrode, the bend and the forward end corner being relatively high in electric field intensity, (i.e., a spark discharge path was dispersed). As a result, local concentration of channeling was able to be effectively restrained.

Particularly, the samples having a length L of 0.5 mm or less have been found to have quite excellent durability. Conceivably, this is for the following reason: through employment of a sufficiently small length L, in the course of spark discharge, energy of collision of charges against the diameter-reducing portion was able to be reduced.

From the above test results, in view that excellent ignition performance is maintained over a long period of time through restraint of channeling while ignition performance is improved, preferably, the first straight portion and the diameter-reducing portion are provided, and the angle α of the diameter-reducing portion is 10° or more.

Also, in view of further improvement of ignition performance, more preferably, the angle α is 45° or less.

Additionally, in order to further improve durability, more preferably, the first straight portion has a length L of 0.5 mm or less, and the angle α is 20° or more. In view of more reliable improvement of durability, more preferably, the first straight portion has a length L of 0.1 mm or more.

Next, there were manufactured ignition plug samples which differed in the shortest distance SL1. The samples were subjected to an insulation performance evaluation test. The insulation performance evaluation test is briefly described below. The samples were mounted to a predetermined chamber. The samples were caused to generate plasma for five minutes at a chamber pressure of 0.8 MPa, a frequency of applied voltage of 60 Hz, and an output of the plasma power supply of 100 mJ (i.e., the samples were brought to a state in which some wear particles adhered to the inner circumferential surfaces of the insulators). In this condition, the samples were measured for resistance between the center electrode and the ground electrode. The samples having a measured resistance of 10 MΩ or more were evaluated as "Good," indicating that the samples have sufficient insulation performance. The sample having a measured resistance of less than 10 MΩ was evaluated as "Poor," indicating that the sample may suffer hindrance to generation of spark discharge. Table 1 shows the results of the test. The samples had a length L of the first straight portion of 0.1 mm and an angle α of 15°. In the samples, the outside diameter of the forward end surface of the center electrode, the inside diameter of the opening of the cavity, etc., were as mentioned above.

TABLE 1

| Shortest distance SL1 (mm) | Insulation performance evaluation |
|---|---|
| 0.8 | Poor |
| 1.0 | Good |
| 1.5 | Good |
| 2.0 | Good |
| 2.5 | Good |
| 3.0 | Good |

As is apparent from Table 1, the samples having a shortest distance SL1 of 1.0 mm or more have sufficient insulation performance and are free from any particular hindrance to generation of spark discharge and in turn, generation of plasma.

From the above test results, in order to ensure sufficient insulation performance so as to more reliably generate plasma, preferably, the shortest distance SL1 is 1.0 mm or more.

Figure 12:
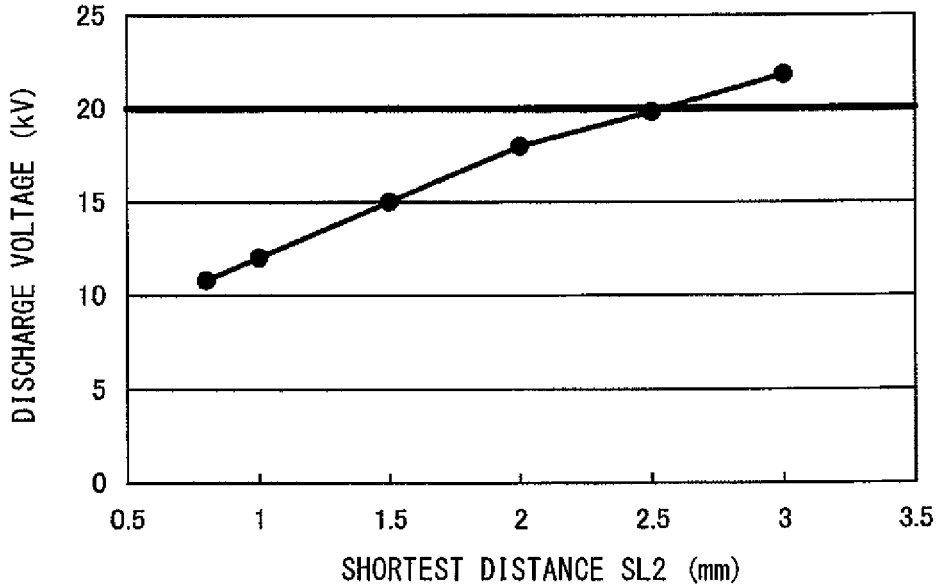
FIG. 12 is a graph showing the results of an initial discharge voltage measurement test conducted on samples which differ in shortest distance SL2.

Next, there were manufactured ignition plug samples which differed in the shortest distance SL2. The samples were subjected to an initial discharge voltage measurement test. The initial discharge voltage measurement test is briefly described below. The samples were mounted to a test chamber and measured for discharge voltage (initial discharge voltage) required for spark discharge, at a chamber pressure of 0.8 MPa. In view that discharge voltage gradually increases with erosion of the center electrode and that the higher the discharge voltage, the more likely channeling arises, preferably, the initial discharge voltage is 20 kV or less. FIG. 12 shows the results of the test. The configurations of the samples were similar to those of the above-mentioned insulation performance evaluation test.

As is apparent from FIG. 12, the samples having a shortest distance SL2 of 2.5 mm or less can more reliably have an initial discharge voltage of 20 kV or less.

From the above test results, in view of prevention of misfire and progress of channeling associated with increase in discharge voltage, preferably, the shortest distance SL2 is 2.5 mm or less.

Figure 13:
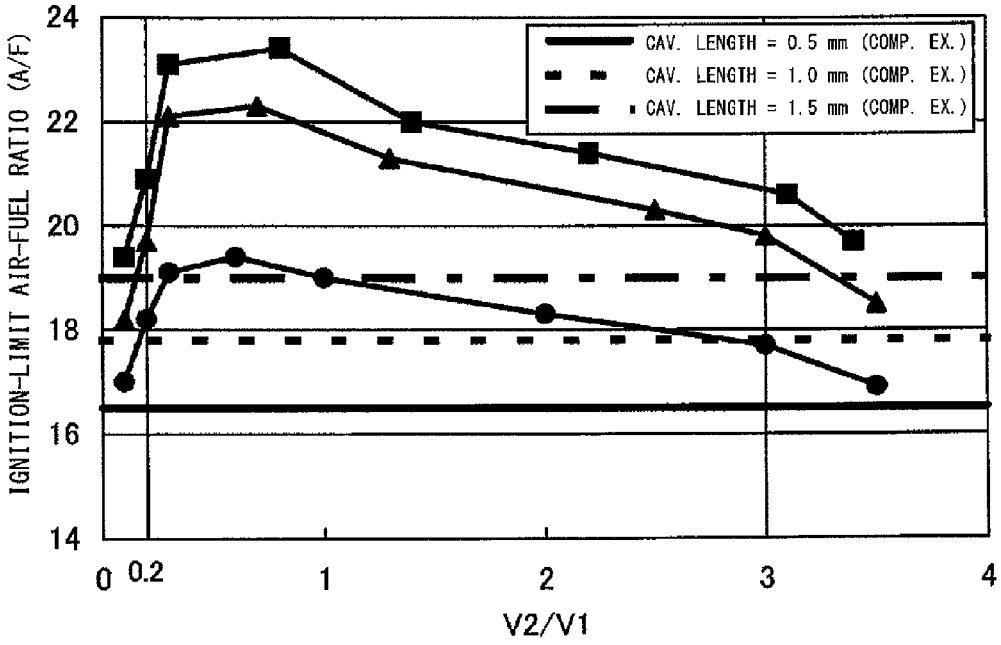
FIG. 13 is a graph showing the results of the ignition performance evaluation test conducted on samples which differ in V2/V1.

Next, there were manufactured ignition plug samples which had a length of the cavity (cavity length) along the axis of 0.5 mm, 1.0 mm, or 1.5 mm and which differed in V2/V1 as effected through varying of the volume V1 ($mm^3$) of the first cavity portion and the volume V2 ($mm^3$) of the second cavity portion. The samples were subjected to the above-mentioned ignition performance evaluation test. FIG. 13 shows the results of the test. In FIG. 13, the test results of the samples having a cavity length of 0.5 mm are plotted with circles; the test results of the samples having a cavity length of 1.0 mm are plotted with triangles; and the samples having a cavity length of 1.5 mm are plotted with squares. The samples had a length L of the first straight portion of 0.1 mm and an angle $\alpha$ of 15°. Additionally, the samples had an outside diameter of the forward end surface of the center electrode of 1.5 mm, an inside diameter of the opening of the cavity (the second cavity portion) of 0.8 mm, and an inside diameter of the through-hole of the ground electrode of 1.0 mm. Furthermore, in FIG. 13, the straight line, the dotted line, and the dot-dash line respectively show the test results of ignition plugs of comparative examples (see FIG. 9) having a circular columnar cavity, an outside diameter of the forward end surface of the center electrode (=inside diameter of cavity) of 1.5 mm, and a cavity length of 0.5 mm, 1.0 mm, or 1.5 mm.

As is apparent from FIG. 13, the samples are superior in ignition performance to the ignition plugs of the comparative examples having respectively the same cavity lengths as those of the samples. Particularly, the samples having a V2/V1 of 0.2 to 3.0 have ignition-limit air-fuel ratios which are 1.0 or more higher than those of the corresponding ignition plugs of the comparative examples having respectively the same cavity lengths, indicating that the samples have quite excellent ignition performance. Conceivably, this is for the following reasons.

(1) Through specification of V2/V1 as 0.2 or more, the first cavity portion had a relatively small volume V1, and thus the first cavity portion was filled with plasma generated therein, whereby discharge pressure of plasma generated in the second cavity portion was able to be rendered sufficiently high. Also, since a certain magnitude of volume was ensured for the second cavity portion, plasma to be discharged from the opening of the cavity with discharge pressure generated in the first cavity portion was sufficiently generated, whereby larger plasma was able to be discharged from the opening of the cavity.

(2) Through specification of V2/V1 as 3.0 or less, the volume V2 of the second cavity portion was prevented from becoming excessively large in relation to the volume V1 of the first cavity portion. Thus, there was able to be more reliably prevented a situation in which plasma is excessively generated in the second cavity portion with a resultant failure to sufficiently discharge plasma with discharge pressure generated in the first cavity portion, whereby the amount of discharge of plasma from the opening of the cavity was able to be increased.

From the above test results, preferably, the volume V1 ($mm^3$) of the first cavity portion and the volume V2 ($mm^3$) of the second cavity portion satisfy the relational expression $0.2 \leq V2/V1 \leq 3.0$.

The present invention is not limited to the above-described embodiment, but may be embodied, for example, as follows. Of course, applications and modifications other than those exemplified below are also possible.

(a) In the above-described embodiment, the ground electrode 27 is formed from a metal which contains W, Ir, etc. However, only an inner circumferential portion of the ground electrode 27 which is eroded in association with spark discharge may be formed from a metal which contains W, Ir, etc.

(b) In the above-described embodiment, the center electrode 5 has the electrode tip 5D at its forward end portion. However, the center electrode 5 may be configured without provision of the electrode tip 5D.

(c) In the above-described embodiment, the ground electrode 27 is in contact with the forward end surface of the ceramic insulator 2. However, the ground electrode 27 and the forward end surface of the ceramic insulator 2 may not be in contact with each other; i.e., some gap may be provided therebetween. However, in view of heat resistance of the ground electrode 27, preferably, the ground electrode 27 and the ceramic insulator 2 are in contact with each other.

(d) In the above-described embodiment, the forward end surface 5F of the center electrode 5 is flat. However, the forward end surface 5F may be, for example, convexly curved (for example, a forward end portion of the center electrode 5 is hemispheric).

(e) In the above-described embodiment, the through-hole 28 and the axial bore 4 are coaxially located (i.e., the center of the through-hole 28 is located on the axis CL1). However, the center of the through-hole 28 may be slightly offset from the axis CL1.

(f) In the above-described embodiment, the tool engagement portion 19 has a hexagonal cross section. However, the shape of the tool engagement portion 19 is not limited thereto. For example, the tool engagement portion 19 may have a Bi-HEX (modified dodecagonal) shape [ISO22977:2005(E)] or the like.

DESCRIPTION OF REFERENCE NUMERALS

1: ignition plug (plasma jet ignition plug);
2: ceramic insulator (insulator);
3: metallic shell;
4: axial bore;
5: center electrode;
27: ground electrode;
28: through-hole;
29: cavity;
41: first straight portion;
42: second straight portion;
43: diameter-reducing portion;
291: first cavity portion;
292: second cavity portion;
CL1: axis.

Having described the invention, the following is claimed:

1. A plasma jet ignition plug comprising:

an insulator having an axial bore extending in a direction of an axis;

a center electrode inserted into the axial bore in such a manner that a forward end surface thereof is located rearward of a forward end of the insulator with respect to the direction of the axis;

a metallic shell disposed externally of an outer circumference of the insulator; and a ground electrode fixed to a forward end portion of the metallic shell, said ground electrode located at a forward end portion of the plasma jet ignition plug;

a cavity being defined by an inner circumferential surface of the axial bore and the forward end surface of the center electrode;

wherein the axial bore comprises:

a first straight portion having a fixed inside diameter and extending forward, with respect to the direction of the axis, from a forward end surface of the center electrode, a gradually reducing diameter portion whose diameter reduces forward with respect to the direction of the axis from a forward end of the first straight portion, and as viewed on a section which contains the axis, a relational expression $\alpha \geq 10$ is satisfied, where $\alpha$ (°) is an acute angle of less than 90° formed by a straight line orthogonal to the axis and an outline of the gradually reducing diameter portion.

2. A plasma jet ignition plug according to claim 1, wherein a relational expression $\alpha \leq 45$ is satisfied.

3. A plasma jet ignition plug according to claim 1, wherein the first straight portion has a length of 0.5 mm or less along the axis.

4. A plasma jet ignition plug according to claim 1, wherein a shortest distance as measured along an inner circumferential surface of the insulator between an opening of the cavity and an imaginary plane which is orthogonal to the direction of the axis and which contains the forward end of the center electrode is 1.0 mm or more.

5. A plasma jet ignition plug according to claim 1, wherein:

the ground electrode is in contact with a forward end surface of the insulator, and a shortest distance as measured along the inner circumferential surface of the insulator between the ground electrode and the imaginary plane which is orthogonal to the direction of the axis and which contains the forward end of the center electrode is 2.5 mm or less.

6. A plasma jet ignition plug according to claim 1, wherein:

the axial bore has a second straight portion having a fixed inside diameter and extending from a forward end of the gradually reducing diameter portion to the opening of the cavity, and a relational expression $0.2 \leq V2/V1 \leq 3.0$ is satisfied, where V1 ($mm^3$) is a volume of a first cavity portion whose circumference is defined by the first straight portion and the gradually reducing diameter portion, and V2 ($mm^3$) is a volume of a second cavity portion whose circumference is defined by the second straight portion.

7. A plasma jet ignition plug according to claim 1, wherein:

the ground electrode assumes a plate-like form and has a through-hole extending therethrough in a plate thickness direction, and as viewed on an imaginary plane which is orthogonal to the axis and onto which are projected an opening of the insulator, an outer circumference of the forward end surface of the center electrode, and an inner circumference of the ground electrode along the direction of the axis, a projected line of the inner circumference of the ground electrode is located between a projected line of the opening of the insulator and a projected line of the outer circumference of the forward end surface of the center electrode.

8. A plasma jet ignition plug according to claim 1, wherein a portion of the center electrode which extends 0.3 mm rearward with respect to the direction of the axis from the forward end of the center electrode is formed from a metal which contains at least one of tungsten, iridium, platinum, and nickel.

9. A plasma jet ignition plug according to claim 1, wherein the ground electrode is formed from a metal which contains at least one of tungsten, iridium, platinum, and nickel.

* * * * *